US006808016B2

(12) United States Patent
Wu et al.

(10) Patent No.: US 6,808,016 B2
(45) Date of Patent: Oct. 26, 2004

(54) EVAPORATIVE HEAT EXCHANGER OF STREAMLINE CROSS SECTION TUBE COIL WITH LESS EVEN WITHOUT COOLING FINS

(75) Inventors: Ho Hsin Wu, I-Lan (TW); Dean Ding, Taipei (TW)

(73) Assignee: Air Tech Co., Ltd., Taipei (TW)

( * ) Notice: Subject to any disclaimer, the term of this patent is extended or adjusted under 35 U.S.C. 154(b) by 0 days.

(21) Appl. No.: 10/349,213

(22) Filed: Jan. 23, 2003

(65) Prior Publication Data

US 2004/0094295 A1 May 20, 2004

(51) Int. Cl.[7] ..... F28D 5/02

(52) U.S. Cl. ..... 165/115; 165/117; 165/151; 62/305

(58) Field of Search ..... 62/305; 165/115, 165/151, 183, 117

(56) References Cited

U.S. PATENT DOCUMENTS

| | | | | | |
|---|---|---|---|---|---|
| 2,166,158 | A | * | 7/1939 | Kalischer | 62/305 |
| 3,349,839 | A | * | 10/1967 | Priestley | 165/115 |
| 4,107,942 | A | * | 8/1978 | Fairman | 62/305 |
| 4,182,131 | A | * | 1/1980 | Marshall et al. | 62/91 |
| 4,361,525 | A | * | 11/1982 | Leyland | 261/152 |
| 4,672,817 | A | * | 6/1987 | Croce | 62/183 |
| 4,755,331 | A | * | 7/1988 | Merrill et al. | 261/153 |
| 5,799,725 | A | * | 9/1998 | Bradley et al. | 165/150 |
| 2002/0023744 | A1 | * | 2/2002 | Kim et al. | 165/177 |

FOREIGN PATENT DOCUMENTS

| | | | | |
|---|---|---|---|---|
| DE | 276815 | * | 1/1914 | 165/183 |
| GB | 1064506 | * | 4/1967 | 165/183 |

* cited by examiner

*Primary Examiner*—Allen J Flanigan
(74) *Attorney, Agent, or Firm*—Troxell Law Office PLLC

(57) ABSTRACT

An evaporative heat exchanger of a medium condenser of a air/conditioning system with less cooling fins or even without cooling fins. The evaporative heat exchanger is composed of a plurality of streamline cross sectional tubes used instead of conventional round tubes for providing an evaporative efficiency, and being easy to clean and maintain.

4 Claims, 16 Drawing Sheets

EVAPORATIVE HEAT EXCHANGER OF STREAMLINE CROSS SECTION TUBE COIL WITH LESS EVEN WITHOUT COOLING FINS

BACKGROUND OF THE INVENTION

The heat exchangers for cooling medium condensing apparatuses conventionally include three types, namely, the air cooling type, the water cooling type and the evaporative type. It is known that heat dissipation efficiency of a water cooling type heat exchanger is slightly better than air cooling type ones, but the heat dissipation efficiency of an evaporative cooling type heat exchanger is much better than a water cooling type because one liter of water absorbs 1 Kcal of heat when raising 1° C., but absorbs 539 Kcal when evaporated.

In addition the cooling efficiency by directly dissipating heat from coil tubes should be better than by indirectly dissipating heat from cooling fins which the heat has to be transferred to cooling fins from coil tubes first.

Therefor, the issue of how to insure a high evaporation efficiency for evaporating the water directly on the surface of tubes of the medium coil is an important problem to be solved.

Further more, a conventional heat exchanger composed of a plurality of cooling fins with a high density of 13 pieces per inch up to 17 pieces per inch, between which it will be easy to deposit dirt and sediment that will corrupt the cooling fins. The fins do not have enough spacing for cleaning and are inconvenient for maintenance.

The present invention solves the problem by utilizing a streamline cross sectional tube instead of a conventional round tube for a medium coil without cooling fins.

FIG. 1A shows a wind flow "w" blowing around a conventional round tube R having a water film thereon, which the wind "w" divides into two flows around the surface of both sides of the round tube respectively to a point F and F' at the rear portion after passed over the diameter DD' thereof, then the wind flow leave the tube surface and pass directly to the back side, therefor the wind flow "w" does not blow over the surface of the arc FF' to produce evaporating effects, it is a great loss of evaporative efficiency therefore, because the surface around the arc FF' is almost larger than ⅓ of the surface of a whole tube, further more there will be a turbulence of eddy current "C" and a windless zone "T" that occurs at a rear space behind the tube that provides a poor cooling efficiency of the next row of tubes of the coil.

FIG. 1B shows a wind flow "w" blowing around a streamline tube S according to the present invention, wherein the wind flow blows toward a larger head portion of a streamline tube, the wind flow "w" is divided into two opposite paths around the streamline surface of the tube, and toward a gradually reduced rear portion where the wind flow blows around the streamline surface after passing over the diameter DD' to an end edge "E". In the present invention, there will be no eddy current and windless zones. Furthermore, according to the theory of aerodynamics the wind speed will increase while the wind blows over the rear portion surface of the streamline tube from point D(&D') to the end edge portion E and a negative pressure "P" will be provide at the edge point E so as to increase an amount of evaporative efficiency while a water film is held instantly on the surface of the tubes.

A Taiwanese utility model application S/N 7320299 shows that a streamline tube can be used for a heat exchanger. However the document does not define what type of heat exchanger has been utilized provides no further description of a practical technology to teach how to use it.

Meanwhile the present invention is quit different having defined a practical technology of heat exchanger without cooling fins by using streamline tubes for medium coils.

A coordinate non-pressure water feeding system is employed in the present invention to supply evaporative water for providing a water film held on the surface of the tubes for enough time to be fully evaporated therefrom.

Furthermore, in case of the evaporative efficiency is fully developed by the coil of streamline tubes itself, the numbers of indirect heat dissipation cooling fins can be greatly reduced to a minimum or fully omitted, therefore it will be easy to clean and convenient to maintain.

Therefore a major object of the present invention is to provide an evaporative heat exchanger for a condenser of an air conditioning system wherein the medium coil is composed of a plurality of streamline cross sectional tubes to instead conventional round tubes so as to increase the evaporative cooling efficiency.

Another major object of the present invention is to provide an evaporative heat exchanger wherein the numbers of conventional cooling fins can be greatly reduced or eliminated to avoid the use of cooling fins so as to reduce manufacturing costs.

Still another main object is to provide an evaporative heat exchanger without cooling fins which will be easy to clean and convenient to maintain.

SUMMARY OF THE INVENTION

The present invention relates to a coil assembly for use in a water evaporative type heat exchanger of a medium condensing cooling apparatus especially relates to a coil assembly having a plurality of streamline cross sectional tubes used instead of the conventional round cross sectional tubes to highly improve the evaporating efficiency and maintain a high E.E.R. thereof, in which the number of cooling fins can be greatly reduced or completely omitted to provide a bare coil that is easy to clean and convenient to maintain.

BRIEF INTRODUCTION OF THE DRAWINGS

DETAILED DESCRIPTION OF THE PRESENT INVENTION

Figure 1A:
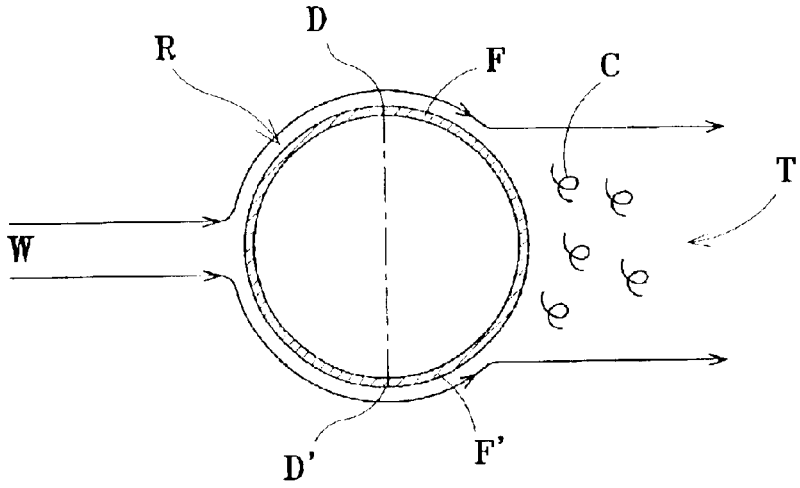
FIG. 1A (PRIOR ART)
FIG. 1A shows a wind flow blowing over a conventional round cross sectional tube.
Figure 1B:
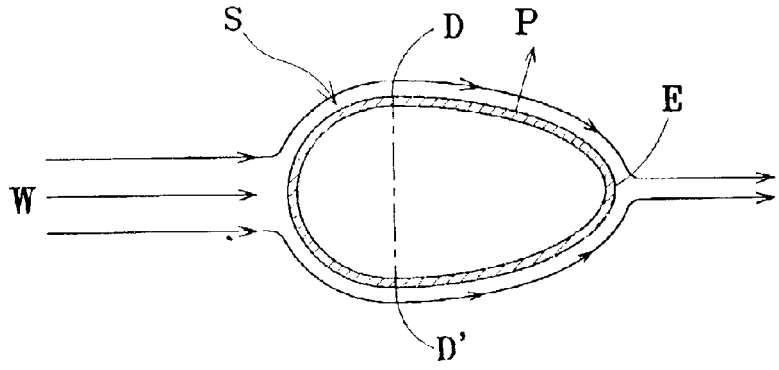
FIG. 1B shows a wind flow blowing over a streamline cross sectional tube according the present invention.
Figure 2:
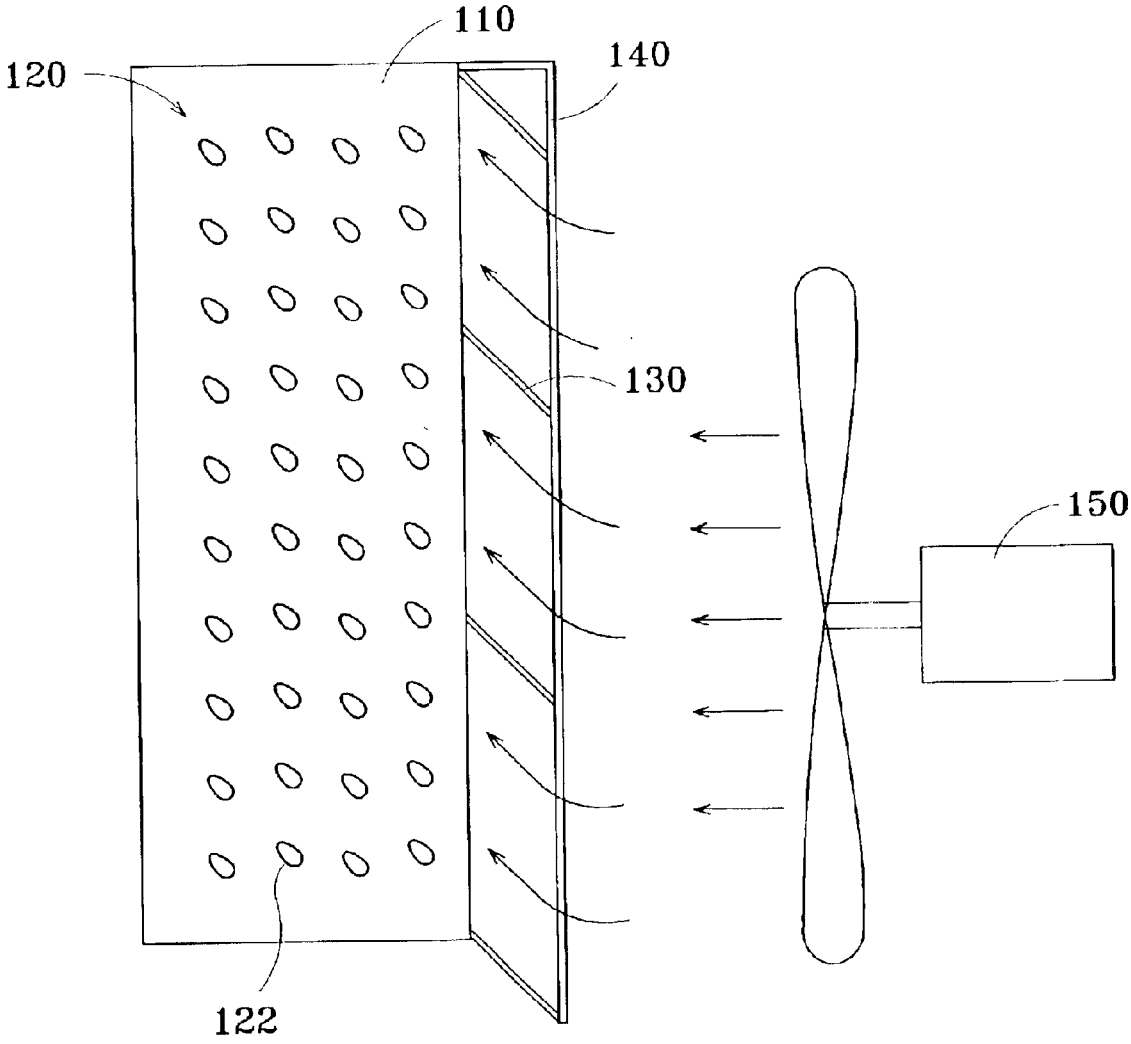
FIG. 2 is a side view of a preferable embodiment according the present invention to show a plurality of streamline tubes arranged for coils in a tilted angle.

FIG. 2 shows a heat exchanger 110 is composed of a plurality fo streamline cross section tubes 112 parallel with a tilted slop formed of at least one set of coils 120, a plurality of wind guiding plates 130 disposed on a supporting frame 140 to guide the wind from a fan system 150 to a direction in parallel with the slope of the streamline tubes to insure that the wind flow will pass through the surface of the streamline tubes smoothly to provide a maximum evaporative cooling efficiency when a water film is covered thereon.

Figure 3:
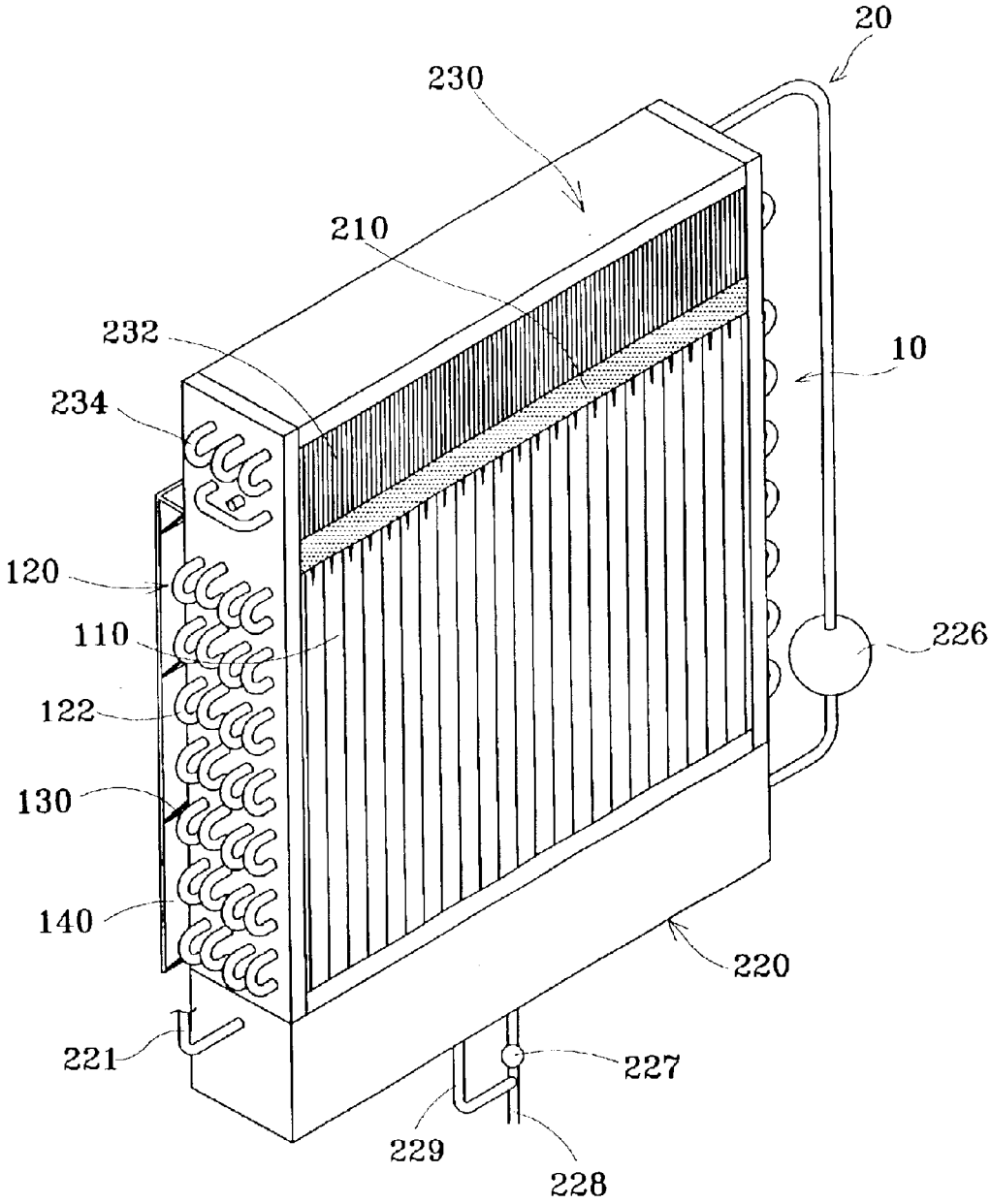
FIG. 3 is a perspective view of an embodiment of a complete condenser apparatus according the present invention.

FIG. 3 shows an embodiment of a complete condenser apparatus 10 according to the present invention. The number of vertical fins 110 has been reduced to provide a wide interval between adjacent fins. The medium coil 120 is composed of a plurality of streamline tubes 122, a plurality of wind guiding plates 130 disposed on a supporting frame 140 at one side (back side as shown), a fan system 150 (not shown, please refer to FIG. 2) delivering a wind flow to blow over the surface of the streamline tubes; a evaporative water recycling feeding system 20 compressing a water distributor 210 of water absorptive foaming material disposed over a top of the cooling fins 110 for seeping non-pressure water drops to distribute water gently and evenly so as to maintain a water film to be held on the surface of the tube 122 having enough time to fully evaporated therefrom, a water tank 220 disposed under the cooling fins 110 to supply evaporative water and collecting the residual water from the cooling fins 110 then recycled by a pump 260, a recycling water pre-cooling heat exchanger 230 disposed at a top over the water distributor pad 210 comprising a plurality of vertical cooling fins 232 and a water coil 234 laterally piercing the fins 232 for pre-cooling the recycling water to avoid over heating due to an accumulating effect of temperature over time.

Figure 3A:
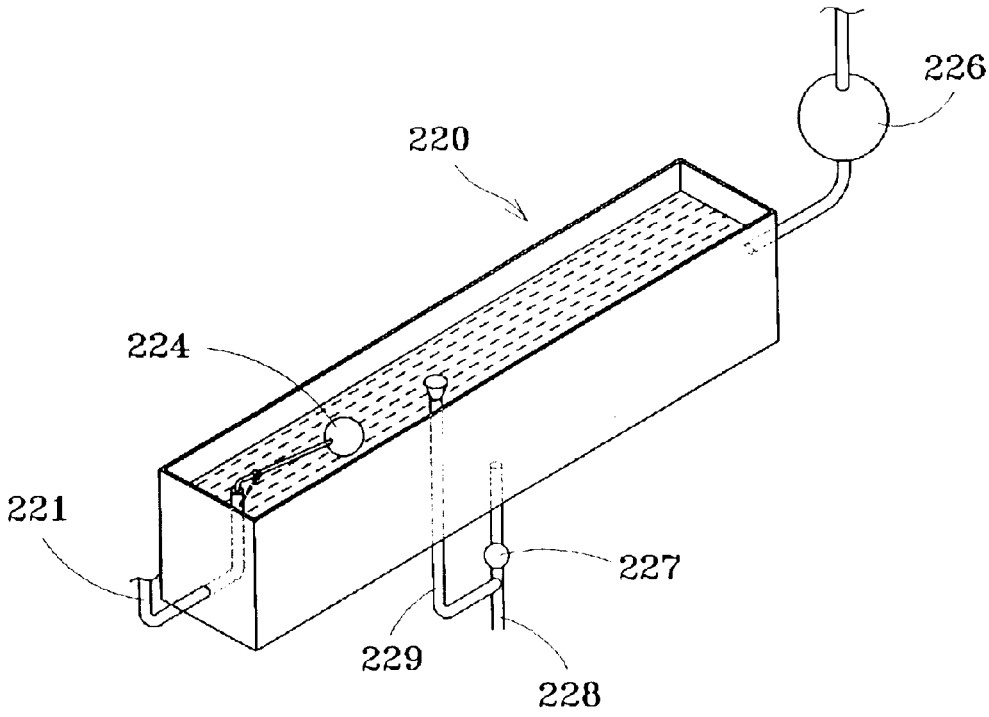
FIG. 3A is a perspective view of a detailed construction of a recycling water tank.

FIG. 3A shows a detailed construction of the recycling water tank 220 having a fresh water supply inlet pipe 221 connected to a water source, a floating valve 223 to keep the water at a constant level, an automatic blow down valve 237 disposed on a blow down pipe 228 under the tank 220 and automatically operated once daily or by-daily to replace the recycled water with fresh water therefore, an over flow exhaust pipe 229 extended out from a bottom of the tank 220 and connected to the blow down pipe 228 and by-passing the blow down valve 227, and having a horn type opening head inside the tank 220 with a height to maintain the constant water level and exhausting over flow water which can include a large amount of residual water when the apparatus is turned off.

Figure 4:
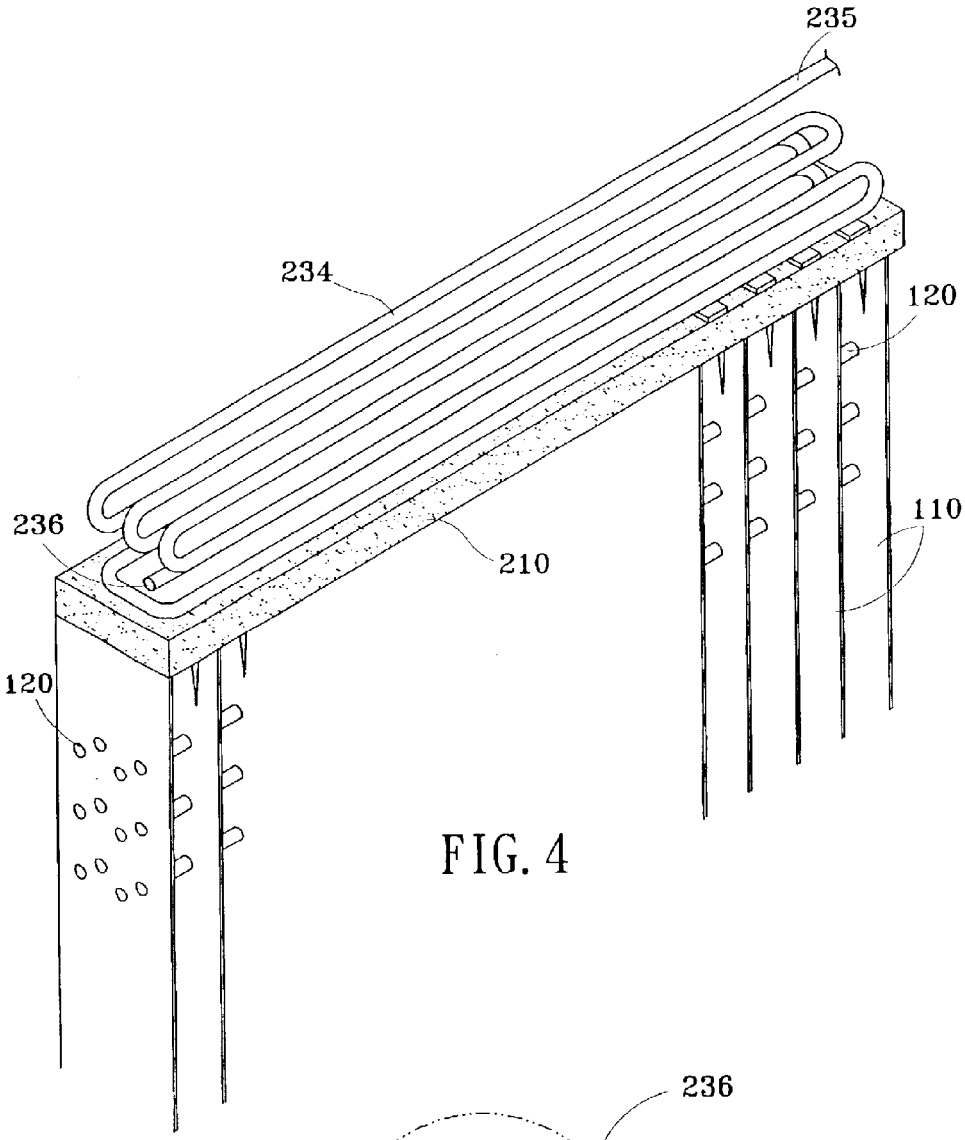
FIGS. 4 and 4A show a water recycling cooling coil and a water distributor of a foaming material pad feeding evaporative water to the medium coil tubes.
Figure 4A:
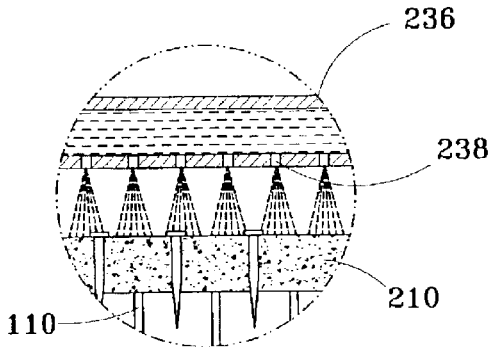

Please referring to FIG. 4 and FIG. 4A, FIG. 4 shows a water coil 234 of a recycling water pre-cooling heat exchanger 20 having a recycling water inlet 235 connected from the pump 260 (see FIG. 3) and a tail tube 236 to spray water on to the water distributor 210, while FIG. 4A is a partial sectional view showing the tail tube 236 spraying water on to the water distributor 210 from a plurality of spray holes 238 thereof.

Figure 5:
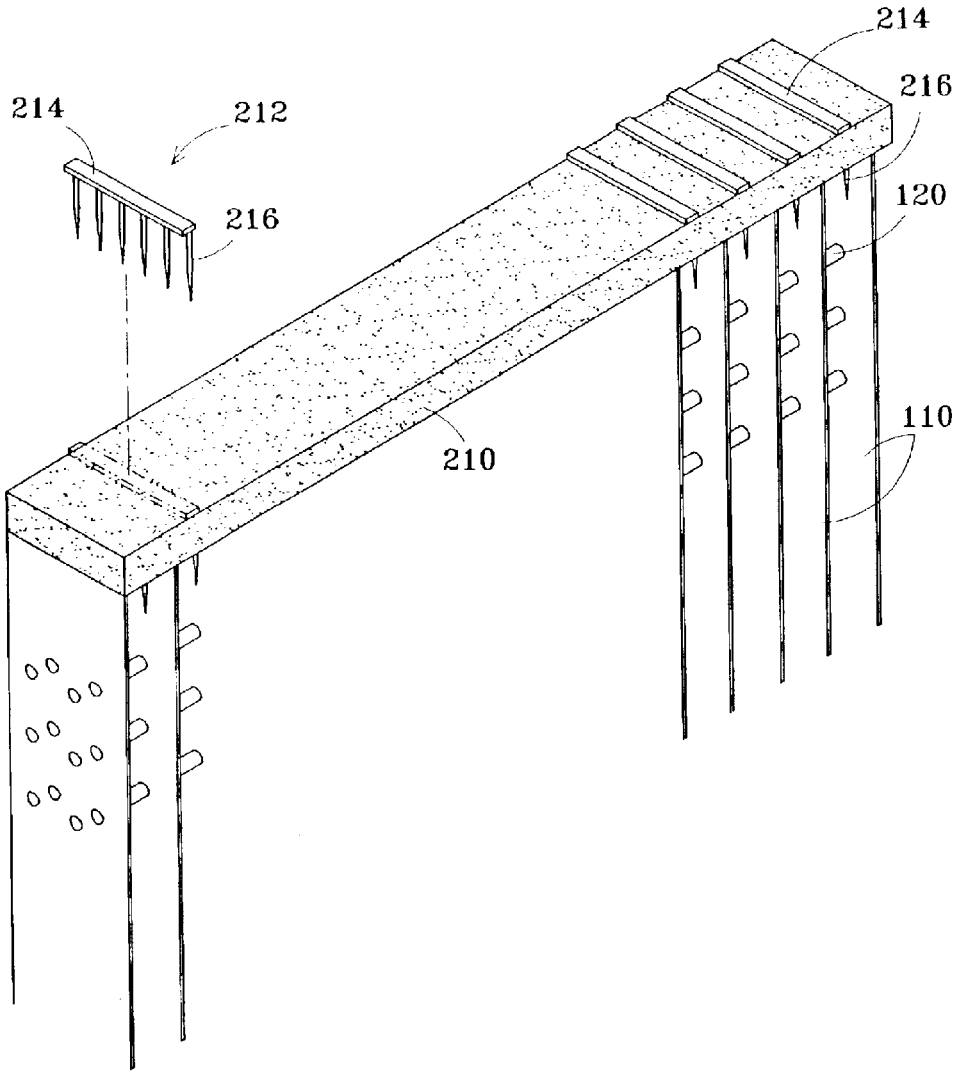
FIGS. 5, 5A and 5B shows multiple rows of needles pierced through the foaming material pad to provide water drops by a needle tip effect.
Figure 5A:
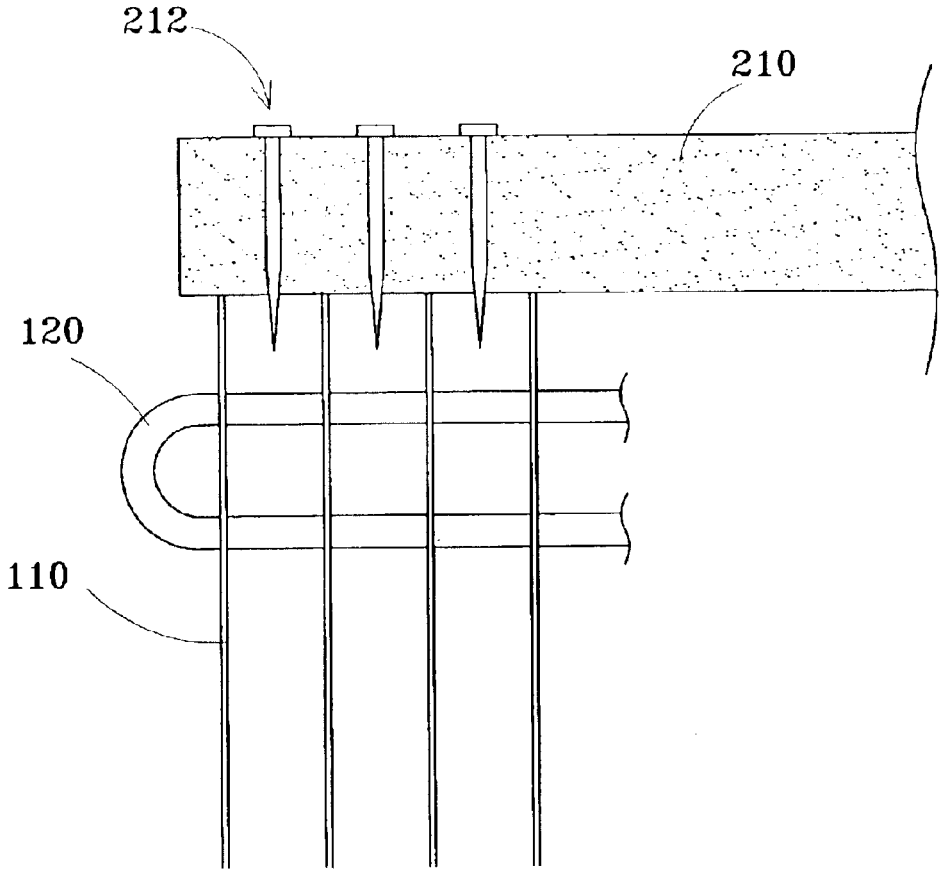
Figure 5B:
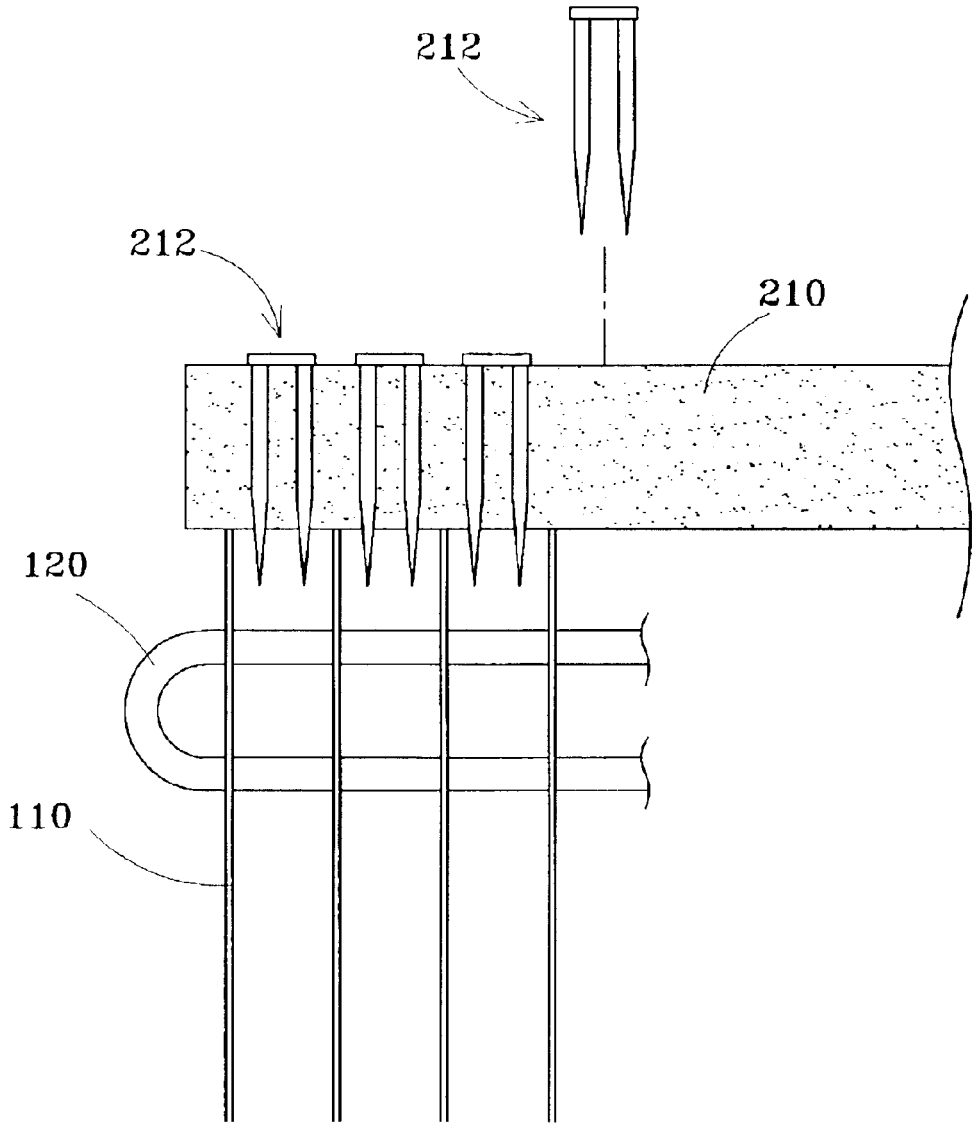

Refer to FIGS. 5, 5A and 5B, a plurality of rows of needle set 212 with the needle tips 216 pierce a bottom of the water distributor 210 at intervals between adjacent cooling fins 110 to guiding the seeping water falling down the streamline tubes drop by drop in a non-pressure manner to provide a water film on the surface of the streamline tube for an instance for enough time to be fully evaporated while the wind flow blows.

Figure 6:
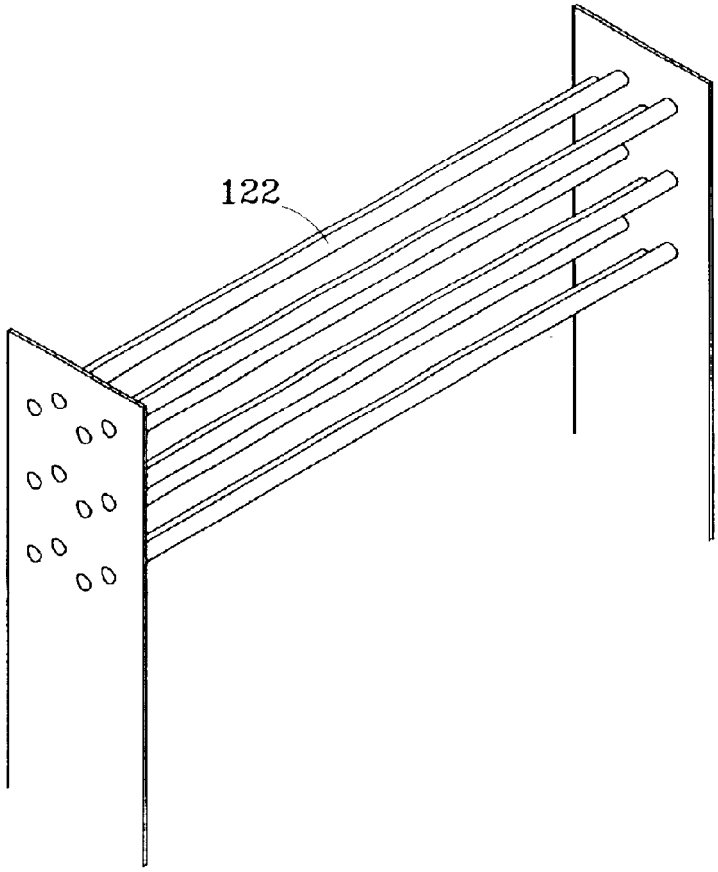
FIG. 6 is a perspective view of another preferable embodiment without cooling fins.

Refer to FIG. 6, a bare coil of streamline tubes 122 without using cooling fins, which is easy to clean and convenient for maintenance.

Figure 7:
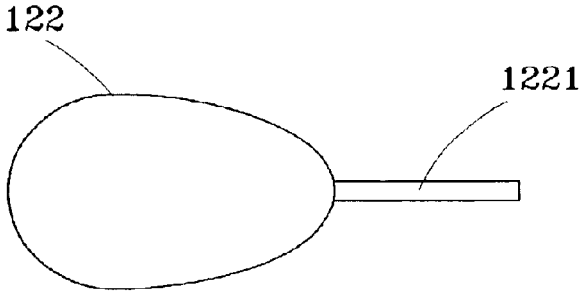
FIG. 7 is a cross sectional view of a tadpole shaped streamline tube having a tail fin extended from a tail edge thereof.

Now please refer to FIG. 7, a tadpole shaped cross sectional tube has a streamline tube 122 with a tail fin 1221 extended from a tail edge thereof, which is used for a bare coil to increase the cooling area of water evaporating.

Figure 8:
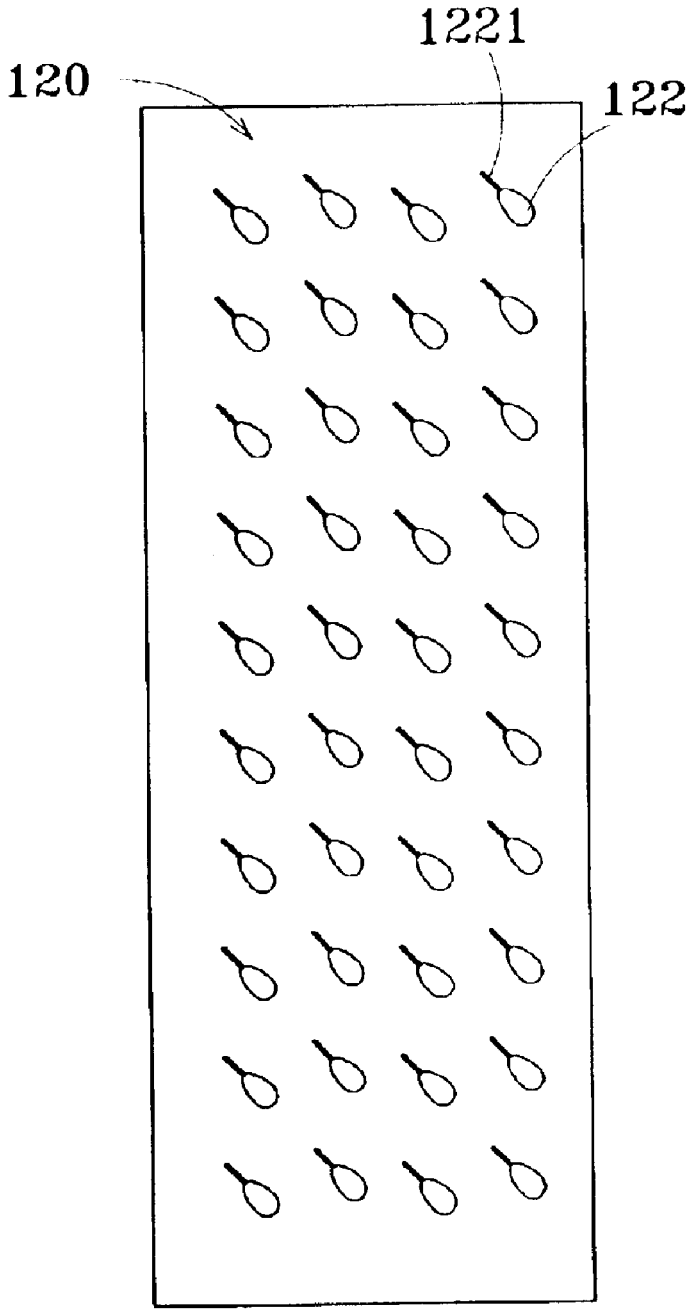
FIG. 8 is a side view of a heat exchanger with a tadpole shaped coil tube without cooling fins.

Refer to FIG. 8, a side view of an embodiment of a bare coil composed of a tadpole shaped streamline tube with a tilt angle thereat.

Finally refer to FIGS. 9A to 9F please, side views of different embodiment of condensers having the medium coil made of streamlining tubes either with a reduced number cooling fins or even without cooling fins according to the present invention.

Figure 9A:
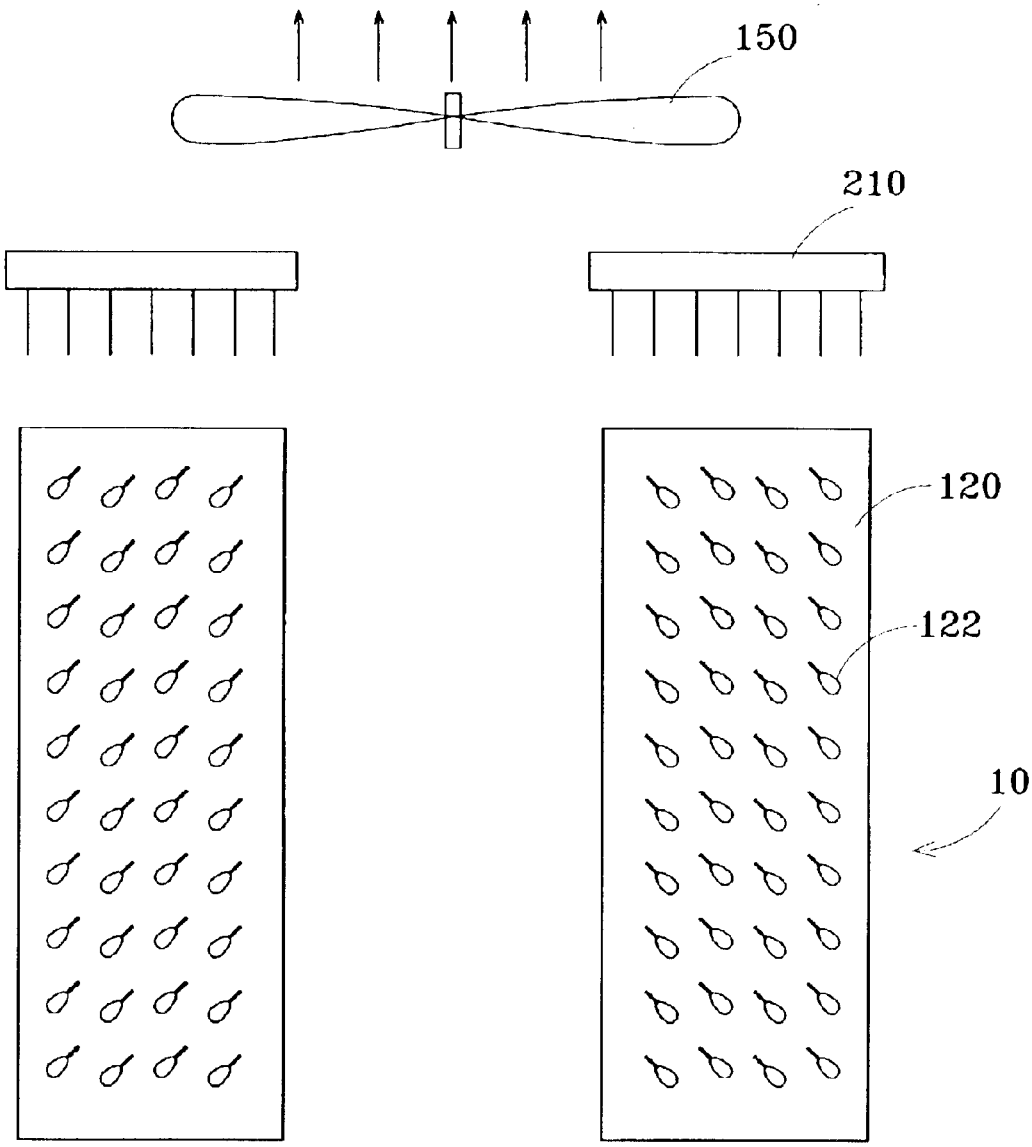
FIG. 9A to FIG. 9F shows other preferable embodiment of different arrangement of the coil and the water feeding system.
Figure 9B:
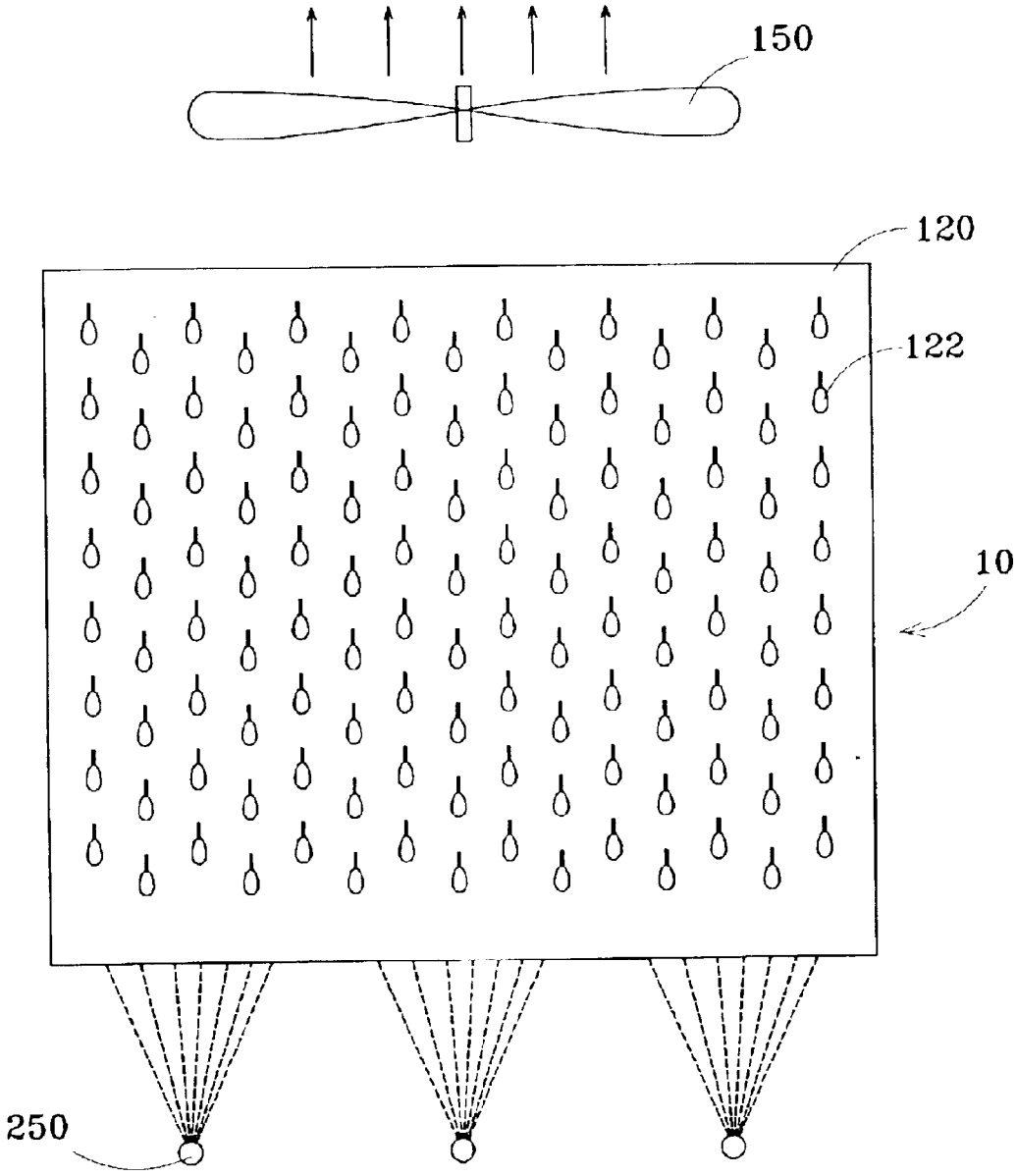
Figure 9C:
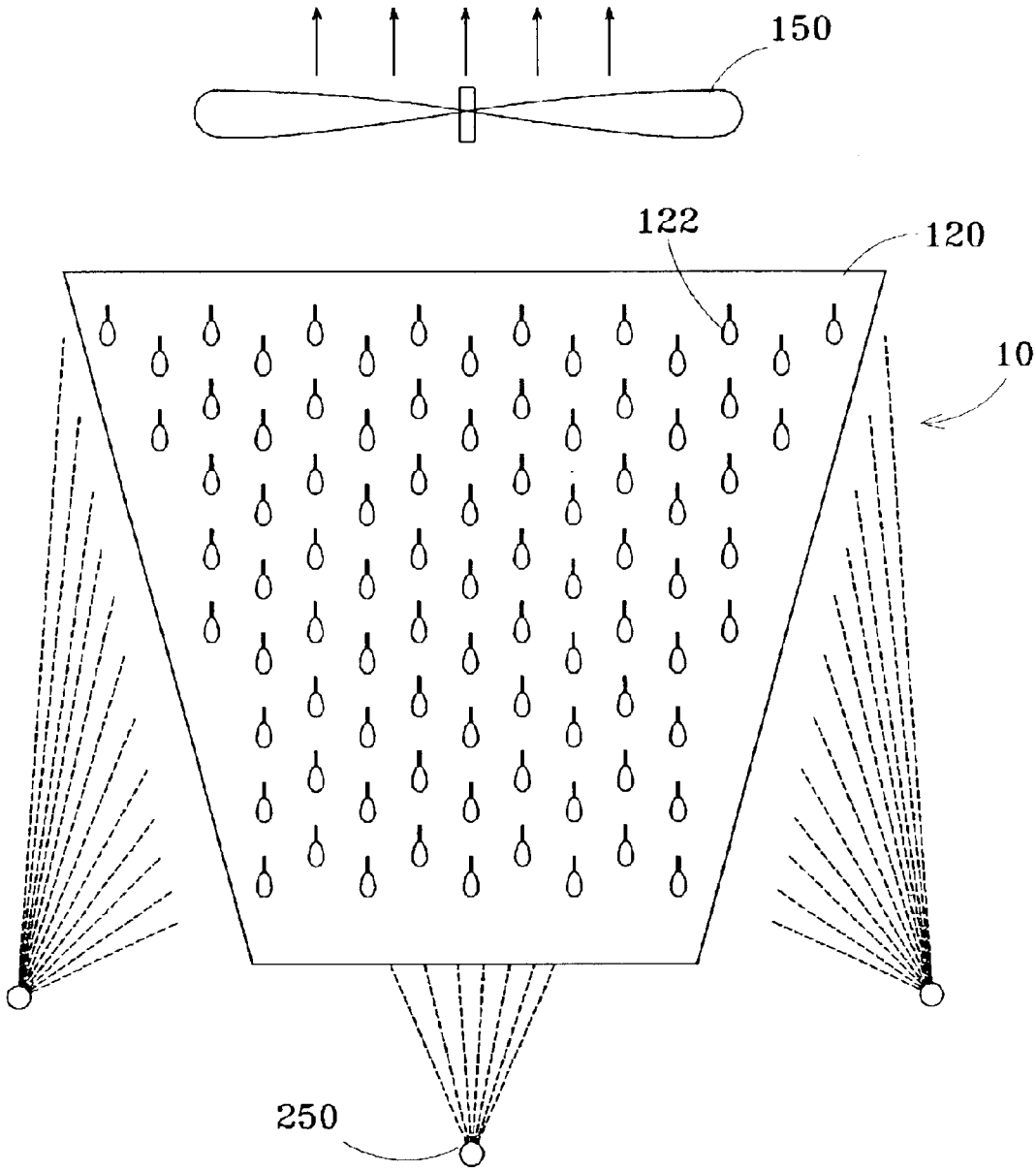

Which FIG. 9A shows an embodiment of two heat exchangers 10 disposed in parallel with coils 120 of streamline tubes 122, a fan system 150 disposed at a top center to draw the air flow blows over the streamline tubes 122 and exhausted out upwardly therefrom, a water distributor 210 disposed respectively at a to of each heat exchanger 10 for feeding evaporative water to the coil tubes 122 therefrom. FIGS. 9B and 9C respectively showing a rectangular and a trapezoid shape heat exchanger 10 having a plurality of vertical streamline tubes 122 of coils 120, a plurality of water spray tubes 250 disposed at a bottom, and a fan system 150 at a top to draw the wind flow upwardly to blow over the streamline tubes 122.

Figure 9D:
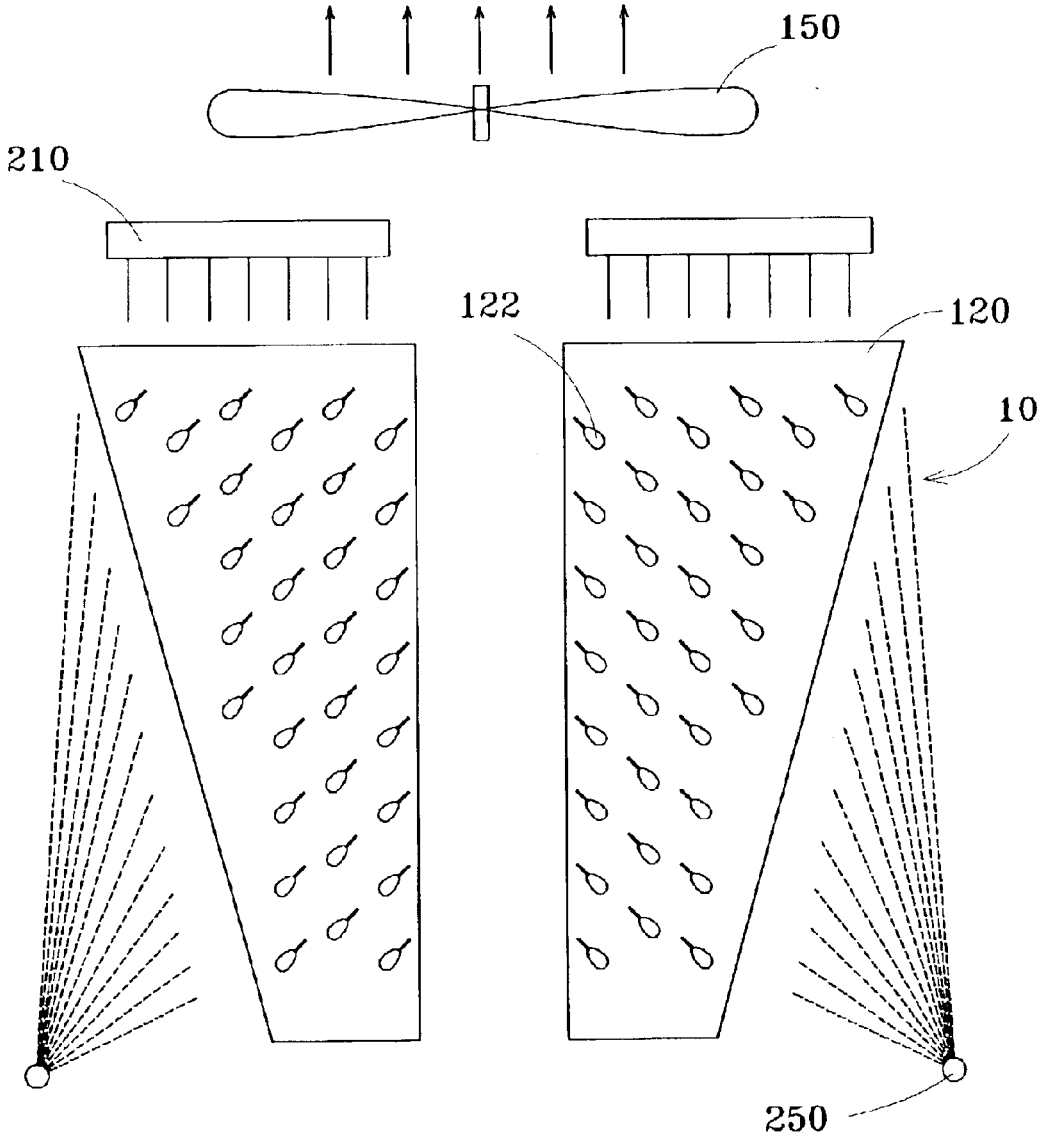

FIG. 9D is one of the preferred embodiments of the present invention having two trapezoid shaped heat exchangers 10 disposed on opposite sides with coil 120 of streamline tubes 122, respectively having a water distributor 210 at a top thereof and two additional water spray tubes 250 disposed to an opposite outside at a bottom respectively to spray water to an under side surface of the streamline tubes to provide an evaporative water film thereon, a fan system 150 disposed at a top to draw the wind upwardly passing over the surface of streamline tubes 122 therefore.

Figure 9E:
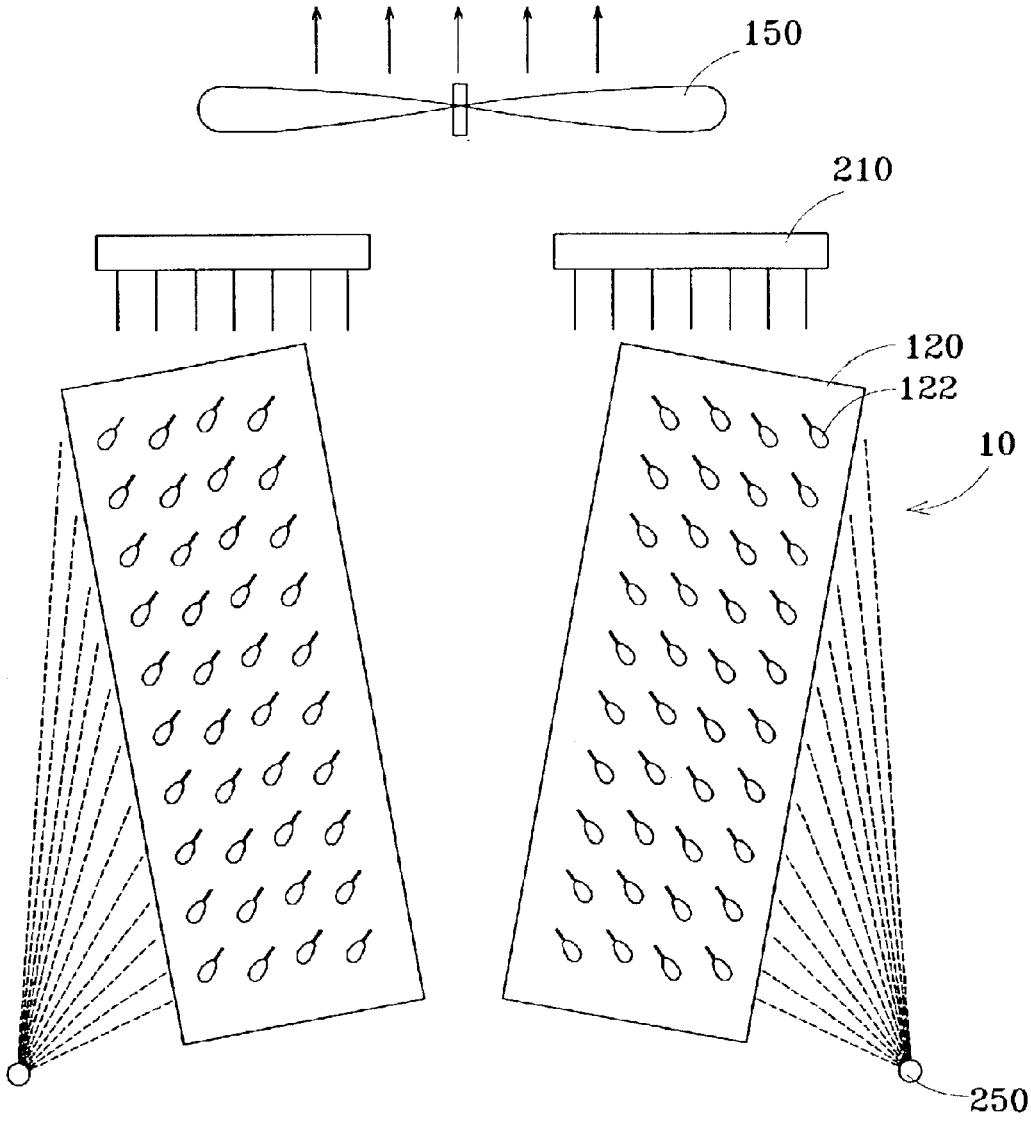
Figure 9F:
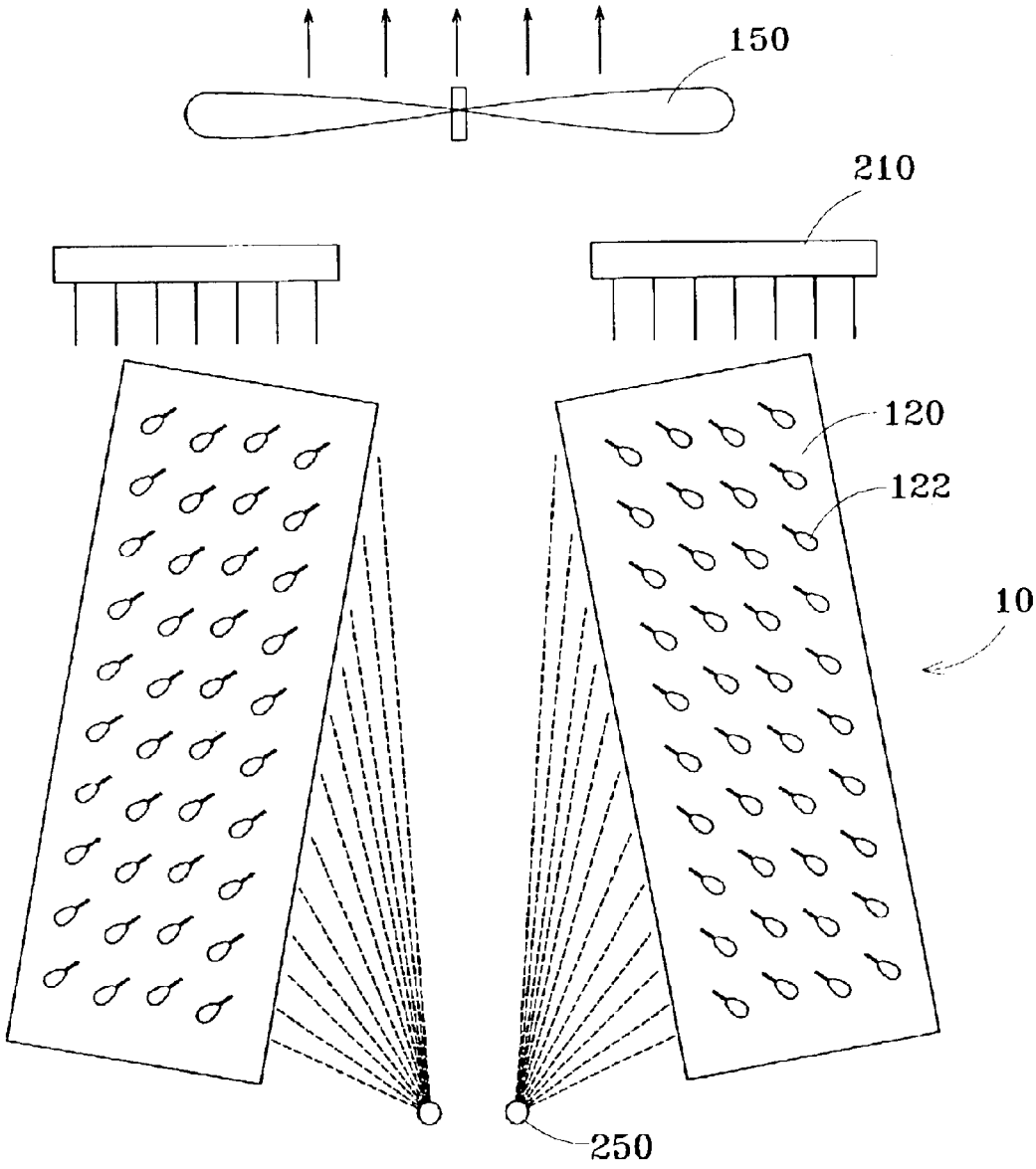

FIGS. 9E and 9F both consist of two opposite heat exchangers 10 similar to FIG. 9D. However, FIG. 9E is composed of a "V" type while FIG. 9F is composed of an "A" type.

It is clear that those figures are just for showing various preferable embodiments according to the present invention, and do not limit the scope of the present invention.

What is claimed is:

1. An evaporative heat exchanger of a cooling medium condenser with a coil of streamline tubes and a reduced number of cooling fins comprising:

a) a plurality of cooling fins disposed vertically in parallel having a wide interval between adjacent fins respectively;

b) a plurality of streamline cross sectional tubes extending laterally through said cooling fins to form a medium cooling coil;

c) a recycling water feeding system feeding water onto a surface of said streamline tubes and having:

i) a water distributor located above said cooling fins for seeping water drops gently and evenly onto said streamline tubes;

ii) a water tank located under said cooling fins to supply evaporated water and to collect residual water from said streamline tubes;

iii) a water pump delivering water from said water tank to said water distributor for recycling; and iv) a recycling water pre-cooling heat exchanger located on a top of said water distributor and cooling recycling water to avoid heating; and d) a wind system providing an air flow blowing over the surface of said streamline tubes for speeding water evaporation on the plurality of streamline cross sectional tubes.

2. The recycling water feeding system of an evaporative heat exchanger according to claim 1, wherein said water distributor comprises:

a pad made of water absorptive foaming material to absorb spraying water from a tail tube of said water coil of said recycling water pre-cooling heat exchanger and seeping water drops while it is in an over saturated state; and a plurality of water guiding needles downwardly piercing said pad and having needle tips protruding from a bottom of said foaming material pad guiding water seeped out drop by drop therefrom due to a needle tip effect.

3. The recycling water feeding system of an evaporative heat exchanger according to claim 1, wherein said water tank comprises:

a water inlet pipe connected to a water source and providing refill water for replacing evaporated water;

a float valve connected to said inlet pipe to maintain a constant water level in the water tank;

a timer controlled blow down valve and an outlet tube located on a bottom thereof to blow down the recycling water at predetermined intervals to automatically flush the water tank; and an over flow exhausting pipe having a horn shaped open end located at a predetermined height in the water tank and connected to said outlet tube by-passing said blow down valve to prevent water from over flowing the water tank.

4. The recycling water feeding system of an evaporative heat exchanger according to claim 1 wherein said recycling water pre-cooling heat exchanger comprises:

a plurality of vertical cooling fins; and a water coil laterally piercing said cooling fins and having an inlet connector connected between said water pump and a tail pipe for spraying water to said foaming material pad of said water distributor.

* * * * *